US007762535B1

(12) United States Patent
Warwick

(10) Patent No.: US 7,762,535 B1
(45) Date of Patent: Jul. 27, 2010

(54) STAVE PRESS

(75) Inventor: Jon Warwick, Madison, MS (US)

(73) Assignee: Warwick Ideas, LLC, Madison, MI (US)

( * ) Notice: Subject to any disclaimer, the term of this patent is extended or adjusted under 35 U.S.C. 154(b) by 822 days.

(21) Appl. No.: 11/434,441

(22) Filed: May 15, 2006

Related U.S. Application Data

(60) Provisional application No. 60/686,359, filed on Jun. 1, 2005.

(51) Int. Cl.
*B25B 11/00* (2006.01)

(52) U.S. Cl. ..... 269/287; 269/76

(58) Field of Classification Search ..... 269/287, 269/149, 258, 274, 76
See application file for complete search history.

(56) References Cited

U.S. PATENT DOCUMENTS 2,773,303 A * 12/1956 Tirone ..... 269/76
4,145,006 A * 3/1979 Webb ..... 269/69
4,834,352 A * 5/1989 Thornton ..... 269/6
5,005,813 A * 4/1991 Lawrence ..... 269/236
5,174,004 A * 12/1992 King et al. ..... 29/251
5,730,433 A * 3/1998 Veres ..... 269/41
7,014,180 B1 * 3/2006 Harrison ..... 269/17

* cited by examiner

*Primary Examiner*—Lee D Wilson
(74) *Attorney, Agent, or Firm*—Gabor L. Szekeres

(57) ABSTRACT

A stave press assembly for holding a wooden stave or other work piece while the stave is fabricated into a bow or other operations are performed on the work piece, has an immovable pressure plate disposed nominally horizontally when the press is attached to a support surface, and a movable pressure plate which can grip an irregularly shaped wooden stave or other work piece by moving it in a downwardly direction toward the immovable pressure plate. The movable pressure plate is pivotable to a limited extent in order to provide a gripping surface for irregularly shaped items and each pressure plate is lined with resilient high friction material.

15 Claims, 3 Drawing Sheets

STAVE PRESS

CLAIM OF PRIORITY OF NON-PROVISIONAL APPLICATION

The present application claims the priority of provisional application Ser. No. 60/686,359, filed on Jun. 1, 2005

BACKGROUND OF THE INVENTION

1. Field of the Invention

The present invention is in the field of bow making equipment. More particularly, the present invention is in the field of equipment particularly suitable for making self bows from a stave of suitable wood. Still more particularly, the present invention is directed to a press designed to hold a stave of wood while a bow is being made from the stave.

2. Brief Description of Background Art

The sport of archery has gained tremendous popularity in the United States of America and in many other countries as well. Bows and arrows are used in an ever increasing number for target shooting (field archery) and for hunting as well, so much so that most states of the United States of America have a special bow hunting season for big game separate from the rifle hunting season for the same game.

One type of presently used archery equipment is based on high technology and involves the use of modern plastic materials such as KEVLAR™, fiber glass or the like for the bow limbs and also cams or the like which substantially reduce the force at which the bow needs to be held while pulled back relative to the maximum pull weight of the bow. This reduction of force is normally termed in the trade "let down". Bows which can be operated with a "let down" are known in the trade as compound bows.

In spite of the availability of the above-noted "high technology" compound bows traditional archery equipment is also popular and used for target shooting and hunting as well. Generally speaking, a bow is considered "traditional" if it lacks "let down", that is any equipment that would reduce the holding weight of the bow relative to its maximum pull weight. Many traditional bows are still products of modern technology and contain advanced materials such as fiberglass carefully laminated and glued together with wood to form the limbs of the bow.

Still another class within the broader class of traditional bows is formed by bows which do not have laminated limbs containing any modern material but rather are made entirely of wood. Such bows are usually termed 'self-bows" and are usually made from a stave of suitable wood. Yew and osage orange serve as examples for trees from which suitable staves for bow making can be obtained, although there are many other species of trees also suitable for this purpose. Self-bows are made by craftsmen specialized in this trade and also by individuals who make the bows as a hobby, and as a matter of self improvement and pride of their own accomplishment.

Making a bow from a suitable stave involves many steps which include forming the stave with a rasp, draw knife, saw, sandpaper and the like into the desired shape. For this and other operations involving cutting, sanding, polishing it is necessary to hold the stave rigidly in a press or vise. The current most common way for bowyers as well as hobbyist making self bows is to squeeze and hold the stave in an ordinary vise that typically has jaws that expand or come together in the horizontal direction. While making self bows there are several important problems occasioned with the use of this type of common vise.

The standard vise has parallel jaws that do not conform to irregularly shaped wood such as a stave from which a self-bow is to be made. This results in the vise crushing the wood grain as the user tightens the jaws to grip the stave tight enough so the user can work on it.

Additionally, jaws of a standard vise are relatively small. They do not provide enough surface area resulting in very high pressure per square inch (psi) bearing on the delicate wood and crushing the wood fibers. However, in order to have a long lasting and well functioning self bow the fibers of the wood must remain intact.

Another disadvantage of using a standard vise for self-bow making is that the jaws grip the wood from the sides only. Therefore, when a bowyer bears weight or force down on the stave from the top, as he often needs to do while making the bow, the weight or force tends to pry the wood out of the vise. The present invention solves the foregoing problems.

Still another disadvantage of using a standard vise for self-bow making is that the jaws of the standard vise do not pivot. This again makes the grabbing of irregularly shaped wood, such as stave for bow making, difficult and results in inadequate holding of the stave and or in crushing of wood fibers.

The above-noted disadvantages of a standard vise are also applicable to wood and other work pieces which need to be held without damage to their surface area and on which force, such as cutting, drilling, rasping, polishing and the like is applied in a substantially vertical direction.

OBJECTS AND SUMMARY OF THE INVENTION

It is an object of the present invention to provide a press that is optimally suited for holding a stave while a self-bow is being manufactured from that stave.

This and other objects and advantages are attained by a press that comprises a nominally horizontally disposed base plate and suitable mechanical means for attaching the base plate to a support surface such as a post or a table top. The base plate includes an interior surface lined with high friction and preferably resilient material. The base plate lined with the high friction material serves as an immovable pressure plate of the stave press of the present invention.

Nominally upright side members are fixedly attached to the base plate on two of its sides and a cover member is attached to the upright members thereby forming an opening into which an object, such as a stave, can be placed horizontally. A threaded hole is located in the cover member and a threaded bolt is engaged in the threaded hole, the bolt being capable of up and down movement within the opening as a result of being turned about its longitudinal axis. A solid plate also lined with high friction and preferably resilient material on its interior surface facing the immovable pressure plate is attached to the end of the threaded bolt by means that allow limited tilting in up and down direction of the solid plate. The means for limited tilting usually comprise a ball joint by which the solid plate is attached to the threaded bolt. The solid plate acts as a movable pressure plate of the stave press and can be moved up and down by turning the threaded bolt and can be pressed tightly against a stave, even when the stave is of irregular shape, to hold the stave firmly while a person works on the stave. Each of the lined high friction surfaces of the pressure plates of the stave press have at least 25 square inch area, whereby the pressure per surface unit (psi) is substantially decreased relative to an ordinary or common vise and the stave press still holds the stave very firmly.

The press of the present invention can also be used for firmly holding a work piece, wood, metal or plastic, without damaging its surface and rendering it practical to apply substantially vertical force to the work piece while performing such operations as cutting, drilling, rasping, polishing and the like.

BRIEF DESCRIPTION OF THE DRAWING FIGURES

DETAILED DESCRIPTION OF THE INVENTION

Figure 1:
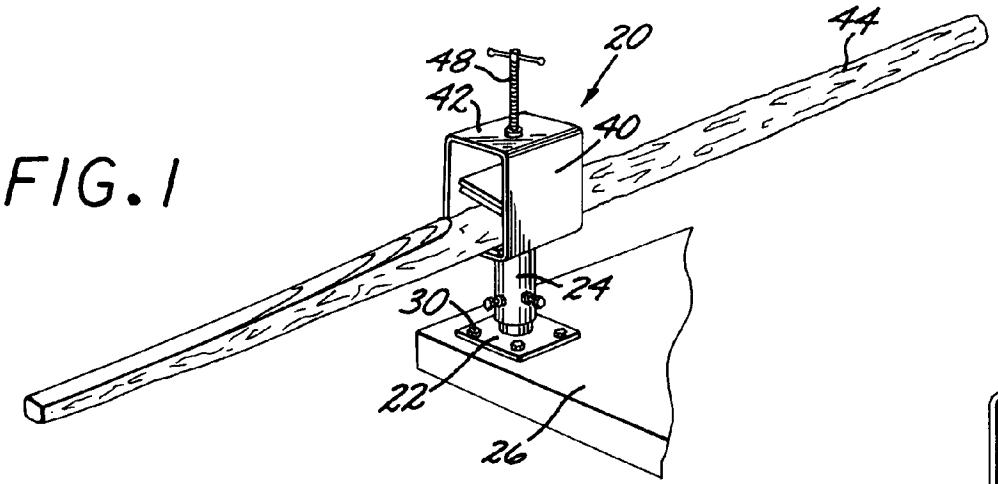
FIG. 1 is a perspective view of the stave press of the present invention holding a stave.
Figure 3:
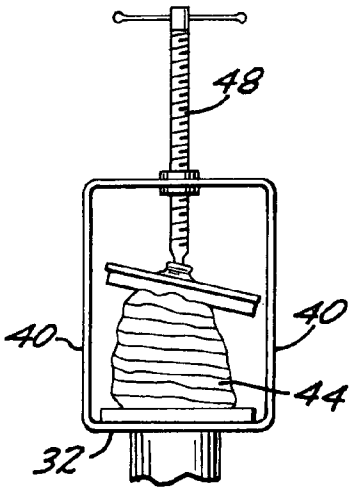
FIG. 3 is an end view of the stave press of the present invention holding a stave.

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing figures, the stave press assembly 20 of the present invention is disclosed. With primary reference to FIGS. 4 and 5 the stave press assembly 20 includes a mounting base 22 which, when the stave press 20 is mounted in the regular way for use, is disposed nominally horizontally.

A cylindrical member 24 is fixedly attached to the mounting base 22. The mounting base 22 and the cylindrical member 24 serve for mounting the stave press 20 to a support base 26 such as a table or work bench. The mounting base 22 includes a plurality of holes 28 through which the mounting base 22 can be attached to the top of the table or workbench 26 by screws 30. Alternatively, the mounting base 26 can also be attached to a workbench 26 (or the like) with clamps (not shown).

Figure 2:
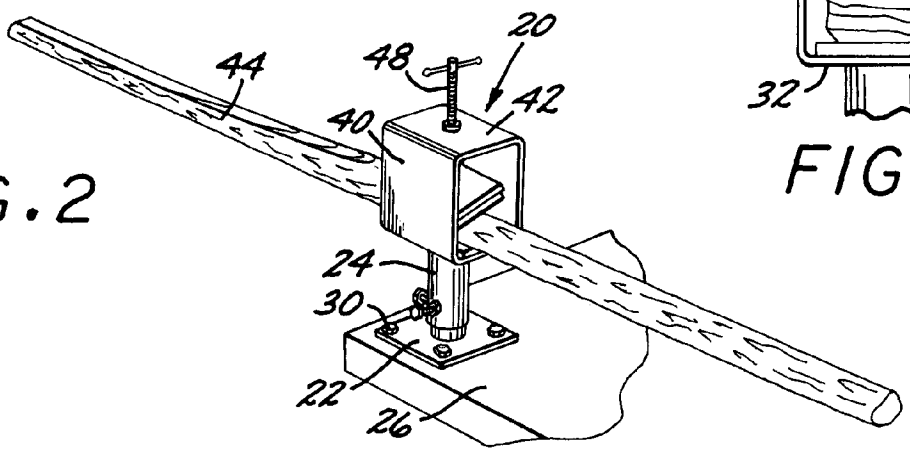
FIG. 2 is another perspective view of the stave press of the present invention holding a stave.

The attachment of the mounting of the base 22 and thereby the entire stave press assembly 20 to the table or workbench 26 with screws 30 is shown in FIGS. 1 and 2. These figures illustrate in an exemplary manner that the stave press assembly 20 can be mounted in different positions to the table or work bench 26 at the option of the user (not shown).

Figure 4:
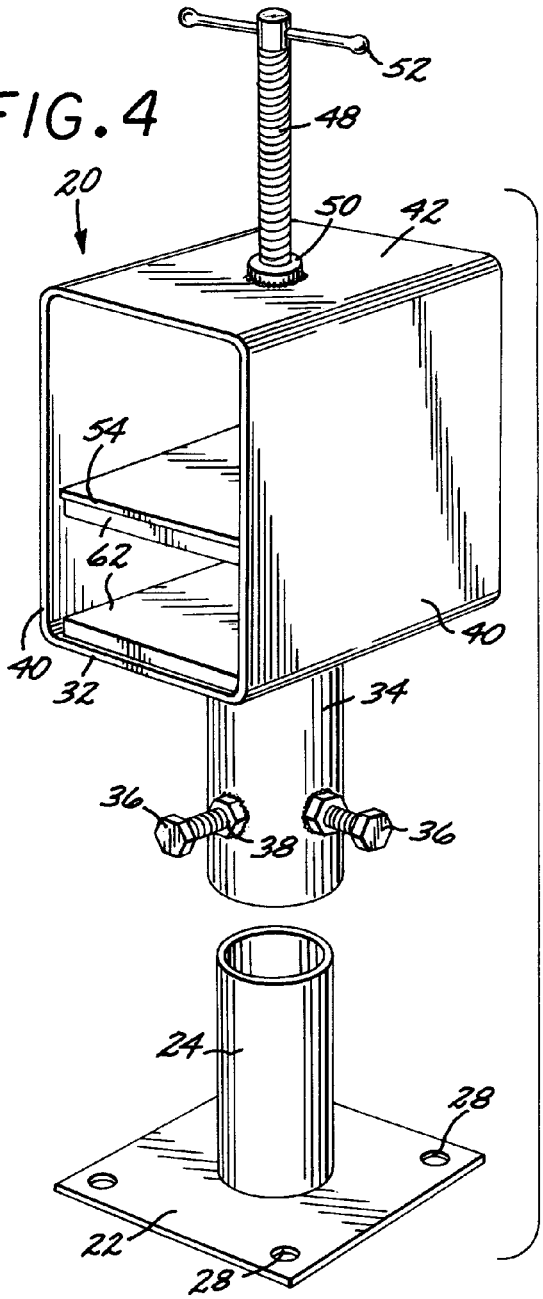
FIG. 4 is a perspective view of the stave press and of the mechanical means used to attach the stave press of the present invention to the support base.
Figure 5:
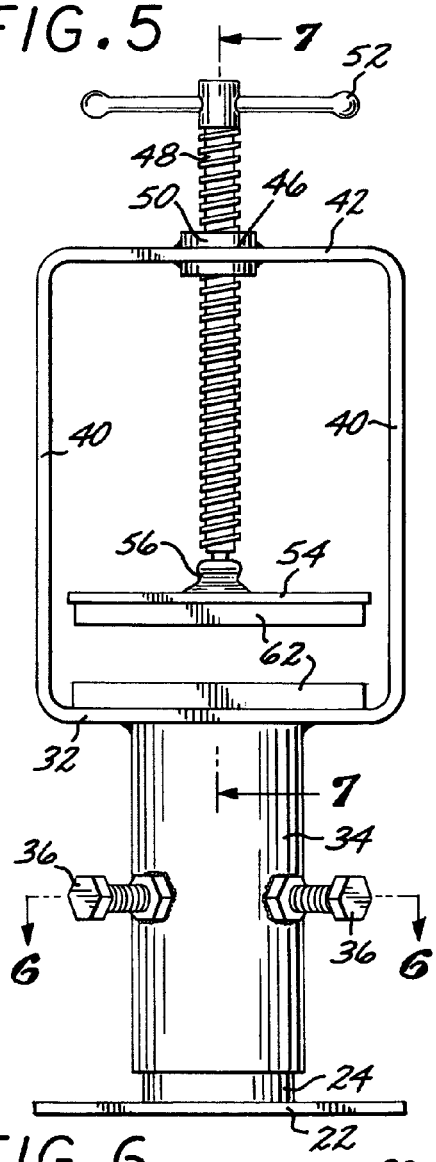
FIG. 5 is a side view, partly in perspective of the stave press of the present invention.
Figure 6:
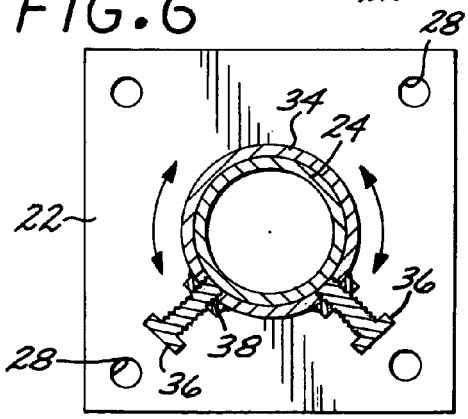
FIG. 6 is a cross-sectional view, the cross section being taken on lines 6,6 of FIG. 5.
Figure 7:
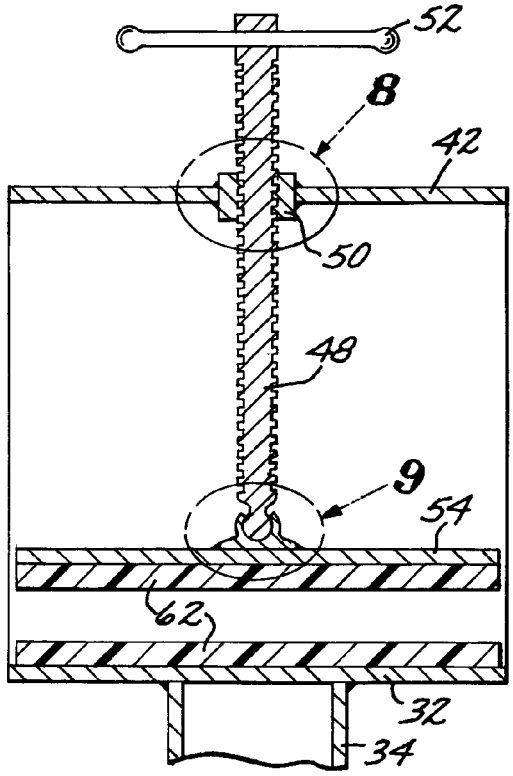
FIG. 7 is another cross-sectional view, the cross section being taken on lines 7,7 of FIG. 5.

Referring now primarily to FIGS. 4, 5 and 6 the stave press assembly 20 includes base plate 32 on the bottom side of which a hollow cylindrical member 34 is attached. The hollow cylindrical member 34 is dimensioned to engage with a tight but removable fit the cylindrical member 24 of the mounting base 22, as best shown in the cross-sectional view of FIG. 6. The hollow cylindrical member 34 can be rotated relative to the solidly mounted cylindrical member 24 of the mounting base 22, as shown in FIG. 6, thereby providing a further option to the craftsman (not shown) to place the stave press assembly 20 in a desired position.

Two or more bolts 36 are engaged in spaced threaded holes 38 of the hollow cylindrical member 34. The bolts 36 when tightened against the cylindrical member 24 of the mounting base 22 mount the entire stave press 20 to the mounting base 22 which is itself solidly mounted to the workbench 26 (or the like) in the manner described above. Thus, the mounting base 22, hollow cylindrical member 34 and the bolts 36 serve as mechanical means for attaching the stave press assembly 20 to a support 26. Other mechanical means, for example a plate (not shown) that is secured to the side of a table or of a workbench could also be used for this purpose. Still other mechanical ways, per se well known in the art, could be used to attach the stave press assembly 20 to a support 26.

Upright side members 40 are affixed to the base plate 32 of the stave press 20 and a cover or top member 42 is affixed to the side members 40 so that the combined base 32, side members 40 and cover or top 42 form an opening into which an object, such as stave 44 of wood (shown in FIG. 1) can be placed in a nominally horizontal direction.

Figure 8:
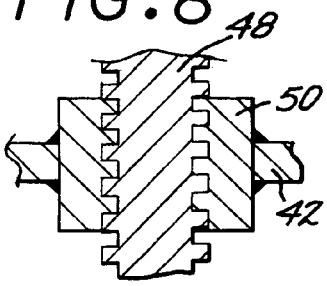
FIG. 8 is an enlarged partial view of the area indicated on FIG. 7.

The cover or top member 42 includes a hole 46 which accommodates a threaded bolt 48. In the herein described preferred embodiment additional material 50 is welded to the cover or top member 42 to reinforce the hole 46. Threads which engage the threaded bolt 48 are provided in the extra material 50. This is shown in FIG. 8. The threaded bolt 48 includes a lever 52 on one end. The lever 52 renders it easy to turn the bolt 48 with substantial force.

Figure 9:
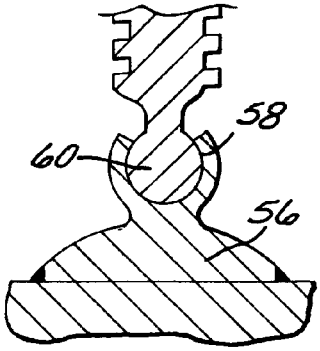
FIG. 9 is another enlarged partial view of the area indicated on FIG. 7.

A solid plate 54 is attached to that end of the bolt 48 which is within the opening formed by the combined base 22, upright side members 40, and top or cover member 42. The solid plate 54 serves as the upper movable pressure plate of the stave press 20. The upper pressure plate 54 is attached to the bolt 48 in such a manner that the upper pressure plate 54 can pivot within a limited range in an up and down direction. This is accomplished by having a swivel foot 56 welded to the top of the movable upper pressure plate 54. The swivel foot 56 includes a hole 58 specially formed to accommodate a ball 60 that is at the end of the threaded bolt 48. These features can be best seen on FIG. 9. Thus, the upper pressure plate 54 is mounted to the bolt 48 with ball joint. The advantage of this arrangement is that the stave press 20 is capable of conforming, in a limited sense, to staves 44 of irregular shape. This is an important feature of the present invention because most staves 44 are of somewhat irregular shape and solidly holding such staves 44 in the stave press 20 is important for the craftsman (not shown) who works on the stave 44.

Generally speaking, the stave press assembly 20 is made from steel and where necessary the various parts are attached to one another by welding.

Figure 10:
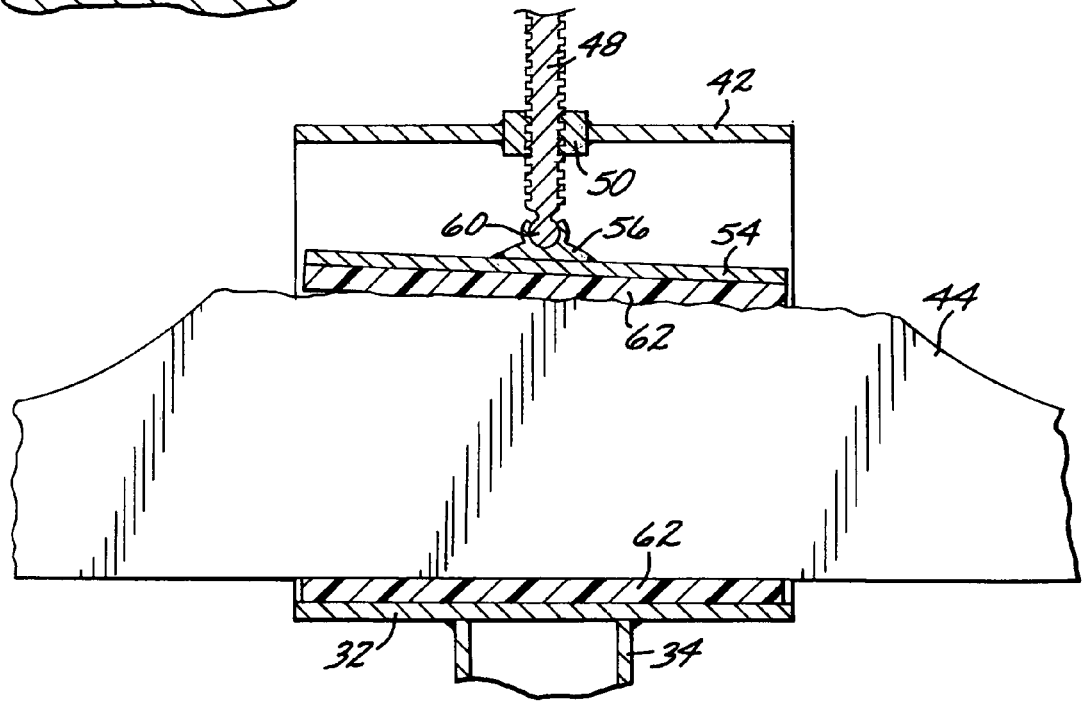
FIG. 10 is a cross-sectional view showing how the stave press holds an irregularly shaped stave.

Referring now primarily to FIGS. 4, 5, 7 and 10 high friction and preferably resilient material 62 is shown to line both the immovable base plate 32 and the movable pressure plate 54. Rubber serves a suitable material for this purpose. Thus, rubber pads 62 of approximately ⅜ inch thickness are glued to the interfacing pressure plates 32 and 54. Instead of rubber other resilient plastic materials of relatively high surface friction can also be used as the resilient lining of the plates 32 and 54. It is a special feature of the present invention that the surface area of each of the pressure plates 32 and 54 is relatively large, at least 25 square inches of larger. In the presently preferred embodiment the surface area of each rubber pad is approximately 34 to 35 square inches. This large surface area, the resilient high friction rubber lining 62 and the ability of the upper pressure plate 54 to pivot and accommodate irregularly shaped staves 44 work together to provide a very strong grip on a stave 44 of wood without crushing the fibers of the wood. FIG. 10 shows a stave 44 for making a self bow (not shown) solidly held in the stave press assembly 20 of the present invention.

Those skilled in the art will readily understand that the press of the present invention can also be used for firmly holding any work piece, wood, metal or plastic, where it is desired to keep the surface of the work piece unblemished and to perform operations such as cutting, drilling, rasping, polishing and the like which include an application of force in the substantially vertical direction.

What is claimed is:

1. A press for holding an elongated work piece, the press comprising:

a base plate forming an immovable pressure plate;

upright side members attached to the base plate at substantially right angles to the base plate;

a cover member attached to the upright side members at substantially right angle to the side members whereby to form an opening into which the work piece can be placed, said opening having a nominally horizontal bottom, a nominally horizontal top and two nominally vertical sides facing each other;

an aperture provided in the cover member and interior threads provided in the aperture;

a threaded bolt mounted into the threaded aperture, the threaded bolt engaging the threads of the aperture;

a ball joint at one end of the bolt;

a second pressure plate mounted to the ball joint and capable of limited pivoting motion in an up and down direction, the second pressure plate mounted to the ball joint interfacing with the immovable pressure plate;

means for mounting the press to a support surface capable of being pivoted on a nominally vertical axis relative to the support surface and for fixing the rotational position of the press in a desired position, and lining comprising resilient high friction material attached to each of the interfacing pressure plates, whereby the work piece can be solidly held in the press between the interfacing lined pressure plates.

2. A press in accordance with claim 1 wherein the lining comprises rubber.

3. A press in accordance with claim 1 where each lining of high friction resilient material has at least 25 square inch of surface area.

4. A press in accordance with claim 1 where each lining comprises rubber and has at least 25 square inch of surface area.

5. A press in accordance with claim 1 where the means for mounting the press to a support surface comprise a mounting plate having a substantially upright cylindrical member and a hollow cylindrical member affixed to the base plate and dimensioned to pivotally engage the upright cylindrical member.

6. A press in accordance with claim 5 where the means for mounting the press to a support surface further comprise a plurality of threaded apertures in the surface of the hollow cylindrical member and a plurality of bolts engaged in the apertures whereby tightening the bolts locks the hollow cylindrical member to the upright cylindrical member.

7. A press in accordance with claim 1 comprising steel and resilient padding material.

8. A stave press assembly for holding a wooden stave while the stave is fabricated into a bow, comprising:

a base plate forming an immovable pressure plate;

upright side members attached to the base plate at substantially right angles to the base plate;

a cover member attached to the upright side members at substantially right angle to the side members to form an opening into which a stave of wood can be placed, said opening having a nominally horizontal bottom, a nominally horizontal top and two nominally vertical sides facing each other;

an aperture provided in the cover member and interior threads provided in the aperture;

a threaded bolt mounted into the threaded aperture, the threaded bolt engaging the threads of the aperture;

a ball joint at one end of the bolt;

a second pressure plate mounted to the ball joint and capable of limited pivoting motion in an up and down direction, the second pressure plate mounted to the ball joint interfacing with the immovable pressure plate;

lining comprising resilient high friction material attached to each of the interfacing pressure plates, each of the lining having at least approximately 25 square inch surface area whereby a stave can be solidly held in the stave press between the interfacing lined pressure plates;

means for mounting the stave press to a support surface comprising a substantially flat mounting plate having a substantially upright cylindrical member and a hollow cylindrical member affixed to the base plate and dimensioned to pivotally engage the upright cylindrical member.

9. A stave press assembly in accordance with claim 8 where the means for mounting the stave press to a support surface further comprise a plurality of threaded apertures in the surface of the hollow cylindrical member and a plurality of bolts engaged in the apertures whereby tightening the bolts locks the hollowly cylindrical member to the upright cylindrical member.

10. A stave press assembly in accordance with claim 8 where each lining comprises rubber.

11. A stave press assembly in accordance with claim 8 comprising rubber and steel materials.

12. A stave press assembly in accordance with claim 8 where the mounting plate includes a plurality of apertures dimensioned to accept screws whereby the mounting plate is attachable to a support surface.

13. A stave press assembly in accordance with claim 8 where the ball joint comprises a member affixed to the second pressure plate, an aperture formed in said member, and a ball formed at the end of the threaded bolt, the ball being disposed in the aperture and the aperture in the member and the ball jointly dimensioned for functioning as ball joint.

14. A stave press assembly for holding a wooden stave while the stave is fabricated into a bow, comprising:

a base plate forming an immovable pressure plate;

upright side members attached to the base plate at substantially right angles to the base plate;

a cover member attached to the upright side members to form an opening into which a stave of wood can be placed, said opening having a nominally horizontal bottom, a nominally horizontal top and two nominally vertical sides facing each other;

an aperture provided in the cover member and interior threads provided in the aperture;

a threaded bolt mounted into the threaded aperture, the threaded bolt engaging the threads of the aperture;

a ball joint at one end of the bolt;

a second pressure plate mounted to the ball joint and capable of limited pivoting motion in an up and down direction, the second pressure plate mounted to the ball joint interfacing with the immovable pressure plate;

lining comprising resilient high friction material attached to each of the interfacing pressure plates, each of the lining having at least approximately 25 square inch surface area whereby a stave can be solidly held in the stave press between the interfacing pressure plates;

means for mounting the stave press to a support surface comprising a substantially flat mounting plate having a substantially upright cylindrical member and a hollow cylindrical member affixed to the base plate and dimensioned to pivotally engage the upright cylindrical member, said means for mounting further comprising a plurality of threaded apertures in the surface of the hollow cylindrical member and a plurality of bolts engaged in the apertures whereby tightening the bolts locks the hollowly cylindrical member to the upright cylindrical member, and a plurality of apertures dimensioned to accept screws whereby the mounting plate is attachable to a support surface.

15. A stave press assembly in accordance with claim 14 where each lining comprises rubber.

* * * * *